US005464735A

United States Patent [19]

Preddy et al.

[11] Patent Number: 5,464,735

[45] Date of Patent: Nov. 7, 1995

[54] SUPERSENSITIZING BIS-BENZOTHIAZOLOCYANINE DYE COMBINATION FOR RED SENSITIVE SILVER HALIDE EMULSIONS

[75] Inventors: Carl R. Preddy, Rochester; John V. Holtzclaw, Fairport, both of N.Y.

[73] Assignee: Eastman Kodak Company, Rochester, N.Y.

[21] Appl. No.: 163,969

[22] Filed: Dec. 7, 1993

[51] Int. Cl.[6] ..... G03C 1/29

[52] U.S. Cl. ..... 430/574; 430/583; 430/585

[58] Field of Search ..... 430/574, 583, 430/585, 567

[56] References Cited

U.S. PATENT DOCUMENTS

| | | | |
|---|---|---|---|
| 3,705,038 | 12/1972 | Phillipaerts et al. | 430/577 |
| 4,118,228 | 10/1978 | Corluy et al. . | |
| 4,555,482 | 11/1985 | Inoue et al. | 430/574 |
| 5,302,506 | 4/1994 | Kagawa et al. | 430/583 |
| 5,354,651 | 10/1994 | Parton | 430/583 |

FOREIGN PATENT DOCUMENTS

| | | | |
|---|---|---|---|
| 87223701/32 | 1/1985 | Japan . | |
| 86234884/36 | 12/1985 | Japan . | |
| 904332 | 8/1962 | United Kingdom | 430/590 |

*Primary Examiner*—Thorl Chea
*Attorney, Agent, or Firm*—John R. Everett

[57] ABSTRACT

There is disclosed a photographic element comprising a layer of a silver halide emulsion containing a sensitizing combination of first and second cyanine red spectral sensitizing dyes according to structure I:

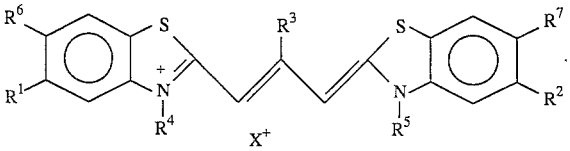

8 Claims, No Drawings

SUPERSENSITIZING BIS-BENZOTHIAZOLOCYANINE DYE COMBINATION FOR RED SENSITIVE SILVER HALIDE EMULSIONS

FIELD OF THE INVENTION

This invention relates photographic elements comprising silver halide emulsions.

BACKGROUND OF THE INVENTION

Many photographic elements include silver halide emulsions having one or more bis-benzothiazolocyanine dyes, in combination with conventional supersensitizers, to spectrally sensitize cyan emulsions to red light. These conventional supersensitizers were effective, but their stain propensity was high. In many emulsions they are retained in the processed and developed emulsion, resulting in an undesirable pink-colored stain in the final image. There is a need for dyes which are more readily removed from the film, while at the same time maintaining good efficiency and proper spectral sensitivity.

The ability of certain cyanine dye combinations to enhance red sensitivity in a superadditive manner ("supersensitization") is well known. Many emulsions incorporate a cyanine dye that is highly insoluble in water and many common organic solvents, requiring an undesirable organic solvent (2-phenoxyethanol) as a vehicle. Little if any of this dye is removed from the emulsion during the development process. An alternative supersensitizer with improved water solubility would be of great practical value, both from the standpoint of solution preparation and post-process retention.

Tabular grain emulsions generally require 2 to 4 times more dye per mass of coated silver than conventional emulsions of similar speed. This places a much greater premium on efficient dye removal. For optimum performance, both the principal dye and its supersensitizer should be designed for easy removal.

SUMMARY OF THE INVENTION

The present invention provides a photographic element comprising a layer of a silver halide emulsion containing a sensitizing combination of first and second cyanine red spectral sensitizing dyes according to structure I:
wherein

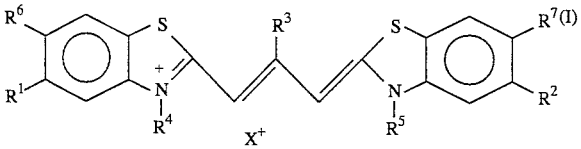

said first dye has substituents according to the following definitions: $R^1$ and $R^2$ represent halogen; $R^3$ represents hydrogen; $R^4$ and $R^5$ represent $R^8$-$CONHSO_2R^9$— or —$R^9$-$CONHSO_2R^8$ wherein $R^8$ is alkyl and —$R^9$ is alkylene; $R^6$ and $R^7$ represent hydrogen, alkyl or alkoxy; and X represents a monovalent cation such as trialkylammonium, tetraalkylammonium, sodium, potassium, lithium or N-alkylpyridinium; and said second dye has substituents according to the following definitions: $R^1$ and $R^2$ represent hydrogen, halogen, alkyl or alkoxy; $R^3$ represents hydrogen or alkyl; $R^4$ and $R^5$ represent sulfoalkyl, carboxyalkyl, sulfoalkylcarbamoylalkyl, sulfoalkylcarbamidoalkyl, sulfo(hydroxy-)alkyl, $R^8$-$CONHSO_2R^9$— or —$R^9$-$CONHSO_2R^8$ wherein $R^8$ is alkyl and —$R^9$ is alkylene; and $R^6$ and $R^7$ represent hydrogen or alkoxy and X represents a monovalent cation, as defined above.

The alkoxy, alkylene and alkyl, substituents included in the above names include 1–5 carbon atoms. Halogen refers to chlorine, bromine, iodine and fluorine.

In a preferred embodiment the invention provides the above described element comprising a combination of dyes according to structure I wherein: said first dye has substituents according to the following definitions: $R^1$ and $R^2$ represent Cl; $R^3$, $R^6$ and $R^7$ represent hydrogen; $R^4$ and $R^5$ represent —$CH_2CONHSO_2CH_2CH_3$, —$CH_2CONHSO_2CH_3$ or —$CH_2CH_2CH_2SO_3H$; and X represents a monovalent cation; and said second dye has substituents according to the following definitions: $R^1$ represents hydrogen, Cl, and —$OCH_3$; $R^2$ represents Cl or phenyl; $R^3$ represents hydrogen or ethyl; $R^4$ and $R^5$ represent 2-$OH(CH_2)_3SO_3H$; —$CH_2(CH_2)_2SO_3H$, —$CH_2CH_2COOH$, —$CH_2(CH_2)_3SO_3H$, or $CH_2CONH(CH_2)_2SO_3H$; and $R^6$ and $R^7$ represent hydrogen or —$OCH_3$ and X represents a monovalent cation.

Elements provided by the present invention enjoy low post-process dye stain, high solubility in common organic solvents such as methanol, and good sensitization efficiency on both conventional and tabular-grain emulsions when used in the combinations defined by the invention.

DETAILS OF THE INVENTION

Dyes according to structure I can be prepared according to the procedures described in U.S. Pat. Nos. 3,282,933 and 4,118,228. In general the total amount of structure 1 dyes present is from $10^{-4}$ to $10^{-2}$ moles per mole of silver halide. The first dye is present in an amount of 10 to 50, preferably 10–25, mole percent of the total dye concentration.

Particularly useful dye combinations include those in which X is tetraethylammonium, the first dye is 10 to 50 mole percent of the combination and is selected from the group consisting of dye numbers 2, 5 and 9 of Table 1 below and the second dye is selected from dye numbers 1, 3, 6, 8, 10 and 12–16 of Table 1 below:

TABLE 1

| Dye No. | $R^1$ | $R^2$ | $R^3$ | $R^4$ & $R^5$ | $R^6$ | $R^7$ |
|---|---|---|---|---|---|---|
| 1 | Cl | Cl | —$CH_2CH_3$ | —$CH_2CONHSO_2CH_3$ | H | H |
| 2 | Cl | Cl | —H | —$CH_2CONHSO_2CH_3$ | | H |
| 3 | Cl | Cl | —$CH_2CH_3$ | —$CH_2CONHSO_2CH_2CH_3$ | H | H |
| 4 | Cl | Cl | —$CH_3$ | —$CH_2CONHSO_2CH_2CH_3$ | H | H |

TABLE 1-continued

| Dye No. | $R^1$ | $R^2$ | $R^3$ | $R^4$ & $R^5$ | $R^6$ | $R^7$ |
|---|---|---|---|---|---|---|
| 5 | Cl | Cl | —H | $—CH_2CONHSO_2CH_2CH_3$ | H | H |
| 6 | Cl | Cl | $—CH_2CH_3$ | $—CH_2CHOHCH_2SO_3$ | H | H |
| 7 | Cl | Cl | H | $—CH_2CHOHCH_2SO_3$ | H | H |
| 8 | Cl | Cl | $—CH_2CH_3$ | $—CH_2(CH)_2SO_3H$ | H | H |
| 9 | Cl | Cl | H | $—CH_2(CH)_2SO_3H$ | H | H |
| 10 | Cl | Cl | $—CH_2CH_3$ | $—CH_2CH_2COOH$ | H | H |
| 11 | Cl | Cl | H | $—CH_2CH_2COOH$ | H | H |
| 12 | Cl | Cl | $—CH_2CH_3$ | $—CH_2CH_2CH(CH_3)SO_3H$ | H | H |
| 13 | $—OCH_3$ | phenyl | $—CH_2CH_3$ | $—CH_2(CH)_2SO_3H$ | $OCH_3$ | H |
| 14 | Cl | phenyl | $—CH_2CH_3$ | $—CH_2CH_2CH(CH_3)SO_3H$ | H | H |
| 15 | Cl | Cl | $—CH_2CH_3$ | $—CH_2CONH(CH_2)_2SO_3H$ | H | H |
| 16 | H | | $—CH_2CH_3$ | $—CH_2(CH)_2SO_3H$ | H | H |

The photographic elements of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). While the order of the color sensitive layers can be varied, they will normally be red-sensitive, green-sensitive and blue-sensitive, in that order on a transparent support, with the reverse order on a reflective support being typical.

In the following discussion of suitable materials for use in elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

The photographic elements of the present may also use colored couplers (e.g. to adjust levels of interlayer correction) and masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides (U.S. Pat. No. 4,923,787); sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; and 4,985,336 as well as in patent publications GB 1,560,240; GB 2,007,662; GB 2,032,914; GB 2,099,167; DE 2,842,063, DE 2,937,127; DE 3,636,824; and DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; and 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Particularly useful in color reversal materials are DIR couplers disclosed in U.S. Ser. Nos. 08/004,027 filed Jan. 15, 1993, 08/005,319 filed Jan. 15, 1993 and 08/007,440 filed Jan. 22, 1993. The contents of each of the 3 applications are expressly incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; and 90-151,577.

The silver halide used in the photographic elements of the present invention may be silver bromoiodide, silver bromide, silver chloride, silver chlorobromide, silver chlorobromo-iodide, and the like. The type of silver halide grains preferably include polymorphic, cubic, and octahedral. The grain size of the silver halide may have any distribution known to be useful in photographic compositions, and may be ether polydispersed or monodispersed. Particularly useful in this invention are tabular grain silver halide emulsions.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred to that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350 5,061,069 and 5,061,616.

The silver halide grains to be used in the invention may be prepared according to methods known in the art, such as those described in *Research Disclosure I* and James, *The Theory of the Photographic Process*. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetols, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure,* June 1975, item 13452 and U.S. Pat. No. 3,772,031.

The silver halide may be sensitized by sensitizing dyes by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention may also usefully include a magnetic recording material as described in *Research Disclosure*, Item 34390, November 1992.

Photographic elements of the present invention are preferably imagewise exposed using any of the known techniques, including those described in *Research Disclosure I*, section XVIII.

Photographic elements comprising the composition of the invention can be processed in any of a number of well-known photographic processes utilizing any of a number of well-known processing compositions, described, for example, in *Research Disclosure I*, or in James, *The Theory of the Photographic Process* 4th, 1977. In the case of processing a reversal color element, the element is first treated with a black and white developer followed by treatment with a color developer known in the art as process E6.

In the following examples the sensitizing dye combinations of the invention were tested in 4 different emulsions A, B, C and D.

Emulsions A, B, and C were conventional silver iodobromide emulsions differing in iodide content and mean grain size. The emulsions were prepared according to paragraph I., subparagraphs E and F of *Research Disclosure,* Number 308, December 1989. The emulsions were prepared by single-jet precipitation in a kettle containing bromide, iodide, and gel. An ammoniacal digestion was then carried out. After neutralization, the emulsion were washed by conventional techniques and more gelatin was added. The three emulsions had the following characteristics:

Emulsion A: 4.8% iodide, 0.45 micron.

Emulsion B: 6.3% iodide, 0.7 micron.

Emulsion C: 3.4% iodide, 0.6 micron.

A representative AgBrI tabular grain photographic emulsion (emulsion D) was prepared according to *Research Disclosure*, supra having a median diameter of 1.4 microns and median thickness of 0.08 microns. The net iodide content was 3%.

Each emulsion was chemically sensitized with a combination of sulfur, gold, and certain modifying addenda under conditions determined to be optimum for speed and fog performance. Spectral sensitizers (dye 1 and dye 2 combinations) were then applied from separate or premixed solutions in equal amounts determined to be optimum for each emulsion.

Four separate emulsions coatings were prepared. Each included one of the above sensitized emulsions (1.08 g/m$^2$), gelatin (2.37 g/m$^2$), 2-[2,4-bis(1,1-dimethylpropyl)phenoxy]-N-[ 4-[(2,2,3,3,4,4,4-heptafluoro-1-oxobutyl)amino]-3-hydroxyphenyl]-hexanamide cyan-dye-forming coupler (1.61 g/m$^2$) dissolved in di-n-butylphthalate (0.80 g/m$^2$), and a surfactant as required to obtain uniform spreading was coated on a clear polyvinylacetate support bearing a nonreflective backing for suppression of halation. A 2.37 g/m$^2$ gel overcoat was applied as a protective layer, along with the hardener bis(vinylsulfonyl)methyl ether in an amount equivalent to 1.5% of total gelatin weight.

EXAMPLE 1

Emulsions coating A, B and C, were exposed on a I-b sensitometer using simulated daylight (5500° K.) from which blue and green light were removed by WRATTEN® 23A or WRATTEN® 29 filters. Coatings were processed for 6 minutes in the E6 rehalogenation process to obtain a negative dye image. Status-A red transmission densitometry was obtained and parameters calculated using accepted algorithms.

Sensitization results are presented in Table 2. Speed is given in units of 100*log(H) for the exposure H giving a threshold response, stated as a signed difference from the control which does not include the first dye of the supersensitizing dye combination of this invention. Any combination of dyes providing a speed increase equal to or greater than 5 is considered as supersensitizing. Lambda(L) max is the wavelength in nanometers of maximum absorption in the red region.

TABLE 2

| Test No. | Emulsion | 1st dye Table 1 | 2nd Dye Table 1 | Moles Dye/Mole AgX | 1st Dye Mol % of Sensitizers | Speed | Lmax |
|---|---|---|---|---|---|---|---|
| 1 | A | | 3 | $4 \times 10^{-4}$ | 0 | 0 | 640 |
| 2 | A | 5 | 3 | $4 \times 10^{-4}$ | 25% | +30 | 642 |
| 3 | A | 5 | 3 | $4 \times 10^{-4}$ | 50% | +29 | 642 |
| 4 | A | 5 | 3 | $4 \times 10^{-4}$ | 75% | +11 | 530* |
| 5 | A | 5 | 3 | $4 \times 10^{-4}$ | 100% | −4 | 530* |
| 6 | B | | 3 | $5.5 \times 10^{-4}$ | 0 | 0 | 640 |

-continued

| Test No. | Emulsion | 1st dye Table 1 | 2nd Dye Table 1 | Moles Dye/Mole AgX | 1st Dye Mol % of Sensitizers | Speed | Lmax |
|---|---|---|---|---|---|---|---|
| 7 | B | 5 | 3 | $5.5 \times 10^{-4}$ | 25% | +36 | 642 |
| 8 | B | 5 | 3 | $5.5 \times 10^{-4}$ | 50% | +38 | 643 |
| 9 | B | 5 | 3 | $5.5 \times 10^{-4}$ | 100% | −2 | 530* |

For emulsions A and B, differing widely in grain size and iodide content, substitution of 25–50 mol % of Dye 3 (2nd dye) with Dye 5 (1st dye) yields approximately one stop (30 units) in additional sensitivity to red light.

Dye 5 is a very poor red sensitizer when present in excess, showing little useful J-aggregation in either emulsion. Dye 3, although it forms a sharp J-aggregate when used alone, gives low efficiency relative to other practical dye combinations. Only the combination gives a useful result. This phenomena, has not been previously reported for combinations involving hydrogen substitution at the $R^3$ position in structure I.

EXAMPLE 2

The tests performed in example 1 were carried out for emulsions C and D. Results of such tests are summarized in Table 3. Speeds are given relative to a control having an equimolar amount of the 2nd dye alone. All dyes have a peak sensitization wavelength between 645 and 655 nm.

TABLE 3

| Test No. | Emulsion | 1st Dye Table 1 | 2nd Dye Table 2 | Mole % Sensitizers | 1st Dye Mole % Sensitizers | Speed |
|---|---|---|---|---|---|---|
| 1 | C | 5 | 3 | $3.4 \times 10^{-4}$ | 25% | +36 |
| 2 | C | 7 | 6 | $3.4 \times 10^{-4}$ | 15% | −2 |
| 3 | C | 5 | 8 | $3.4 \times 10^{-4}$ | 25% | +25 |
| 4 | C | 9 | 8 | $3.4 \times 10^{-4}$ | 15% | +7 |
| 5 | C | 11 | 10 | $3.4 \times 10^{-4}$ | 15% | −1 |
| 6 | D | 5 | 6 | $8 \times 10^{-4}$ | 25% | +8 |
| 7 | D | 4 | 6 | $8 \times 10^{-4}$ | 25% | −10 |
| 8 | D | 3 | 6 | $8 \times 10^{-4}$ | 25% | −15 |
| 9 | D | 5 | 13 | $8 \times 10^{-4}$ | 25% | +11 |
| 10 | D | 5 | 14 | $8 \times 10^{-4}$ | 25% | +25 |
| 11 | D | 5 | 15 | $8 \times 10^{-4}$ | 25% | +19 |
| 12 | D | 5 | 16 | $8 \times 10^{-4}$ | 25% | +12 |

Table 3 shows that supersensitization occurs with other combinations of dyes within structure I. However some combinations do not provide sensitization. The combination that produce supersensitization is not obvious.

Dye 5 types can supersensitize their own analogs in which $R^3$ is ethyl (Test 1), and a variety of other dyes as well (Tests 4, 8, and 10–14). Hydrogen substitution at $R^3$ is essential but not sufficient to obtain supersensitization. Methyl or ethyl analogs are not effective. Hydrogen substitution at $R^3$ together with $R^8$—$CONHSO_2R^9$— or —$R^9$—$CONHSO_2R^8$ substituents at both $R^4$ and $R^5$ is needed to make dye 5 types useful in the dye combinations of the invention.

EXAMPLE 3

The amount of sensitizing dye retained in reversal-processed film can be determined from transmission spectra of model coatings which have received a high level of light exposure, then subjected to processing designed for multicolor reversal images as described in *Research Disclosure,* number 308, December, 1989 Section XIX D (E6 process). Since coatings prepared and processed in this manner contain no other components which possess or form absorptances in the green and red region, the optical density of any peaks in the 550–650 nm region is directly related to the amount of retained sensitizing dye. A density baseline was established by processing and reading a coating containing no emulsion.

The tabular silver halide emulsion (D) was used for these tests. The total amount of dye was held constant at $1.0 \times 10^{-3}$ moles per mole of silver halide. This is typical of red-sensitized T-grains, and is roughly a threefold increase versus the experiments with the nontabular emulsions of example 1. This emphasizes that low dye retention is especially critical with tabular emulsions. Results appear in Table 4.

TABLE 4

| Test No. | 1st Dye Table 2 | 2nd Dye Table 1 | Mole % Sensitizers | 1st Dye Mole % of Sensitizer | Stain |
|---|---|---|---|---|---|
| Control | Commercial[1] | 6 | $1 \times 10^{-3}$ | 25 | 0.015 |
| 1 | 5 | 6 | $1 \times 10^{-3}$ | 25% | 0.000 |
| 2 | 2 | 6 | $1 \times 10^{-3}$ | 25% | 0.000 |
| 3 | 5 | 1 | $1 \times 10^{-3}$ | 25% | 0.000 |
| 4 | 2 | 1 | $1 \times 10^{-3}$ | 25% | 0.000 |

The supersensitizer combinations of the invention are completely removed compared to the control. The control dye is in current commercial use in red sensitive silver halide emulsion layers. The dye is 5-[bis{(1-ethylnaphtho{1,2-d}thiazol-2(1H)-ylidene)methyl}methylene]-1,3-bis-(2-methoxyethyl)barbituric acid.

The invention has been described in detail with particular reference to preferred embodiments thereof, but it will be understood that variations and modifications can be effected within the spirit and scope of the invention.

We claim:

1. A photographic element comprising a layer of a silver halide emulsion containing a sensitizing combination of first and second cyanine red spectral sensitizing dyes according to structure I:

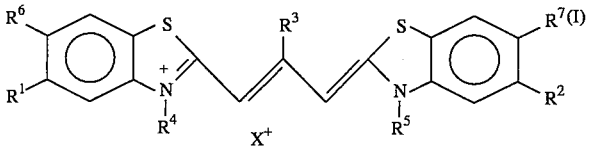

said first dye has substituents according to the following definitions: $R^1$ and $R^2$ represent halogen; $R^3$ represents hydrogen; $R^4$ and $R^5$ represent $R^8$-$CONHSO_2R^9$— or —$R^9$-$CONHSO_2R^8$ wherein $R^8$ is alkyl and —$R^9$ is alkylene; $R^6$ and $R^7$ represent hydrogen, alkyl or alkoxy; and X represents a monovalent cation trialkylammonium, tetraalkylammonium, sodium, potassium, lithium or N-alkylpyridinium; and said second dye has substituents according to the following definitions: $R^1$ and $R^2$ represent hydrogen, halogen, alkyl or alkoxy; $R^3$ represents alkyl; $R^4$ and $R^5$ represent sulfoalkyl, carboxyalkyl, sulfoalkylcarbamoylalkyl, sulfoalkylcarbamidoalkyl, sulfo(hydroxy)alkyl, $R^8$-$CONHSO_2R^9$— or —$R^9$—$CONHSO_2R^8$ wherein $R^8$ is alkyl and —$R^9$ is alkylene; and $R^6$ and $R^7$ represent hydrogen or alkoxy and X represents a monovalent cation, as defined above.

2. The element of claim 1 wherein contains $10^{-4}$ to $10^{-2}$ moles of total sensitizer per mole of silver halide and the combination of dyes according to structure I wherein: said first dye has substituents according to the following definitions: $R^1$ and $R^2$ represent Cl; $R^3$, $R^6$ and $R^7$ represent hydrogen; $R^4$ and $R^5$ represent —$CH_2CONHSO_2CH_2CH_3$, —$CH_2CONHSO_2CH_3$; and X represents a monovalent cation; and said second dye has substituents according to the following definitions: $R^1$ represents hydrogen, Cl and —$OCH_3$; $R^2$ represents Cl or phenyl; $R^3$ represents ethyl; $R^4$ and $R^5$ represent —$CH_2CHOHCH_2SO_3$ —$CH_2(CH_2)_2SO_3H$, —$CH_2CH_2COOH$, —$CH_2(CH_2)_3SO_3H$, or $CH_2CONH(CH_2)_2SO_3H$; and $R^6$ and $R^7$ represent hydrogen or —$OCH_3$ and X represents a monovalent cation.

3. The element of claim 2 wherein X is tetraethylammonium, the first dye is 10 to 50 mole percent of the combination and is selected from the group consisting of dye numbers 2 and 5 of Table 1 below and the second dye is selected from dye numbers 1, 3, 6, 8, 10 and 12–16 of Table 1 below:

TABLE 1

| Dye No. | $R^1$ | $R^2$ | $R^3$ | $R^4$ & $R^5$ | $R^6$ | $R^7$ |
|---|---|---|---|---|---|---|
| 1 | Cl | Cl | —$CH_2CH_3$ | —$CH_2CONHSO_2CH_3$ | H | H |
| 2 | Cl | Cl | —H | —$CH_2CONHSO_2CH_3$ | | H |
| 3 | Cl | Cl | —$CH_2CH_3$ | —$CH_2CONHSO_2CH_2CH_3$ | H | H |
| 4 | Cl | Cl | —$CH_3$ | —$CH_2CONHSO_2CH_2CH_3$ | H | H |
| 5 | Cl | Cl | —H | —$CH_2CONHSO_2CH_2CH_3$ | H | H |
| 6 | Cl | Cl | —$CH_2CH_3$ | —$CH_2CHOHCH_2SO_3$ | H | H |
| 7 | Cl | Cl | H | —$CH_2CHOHCH_2SO_3$ | H | H |
| 8 | Cl | Cl | —$CH_2CH_3$ | —$CH_2(CH)_2SO_3H$ | H | H |
| 9 | Cl | Cl | H | —$CH_2(CH)_2SO_3H$ | H | H |
| 10 | Cl | Cl | —$CH_2CH_3$ | —$CH_2CH_2COOH$ | H | H |
| 11 | Cl | Cl | H | —$CH_2CH_2COOH$ | H | H |
| 12 | Cl | Cl | —$CH_2CH_3$ | —$CH_2CH_2CH(CH_3)SO_3H$ | H | H |
| 13 | —$OCH_3$ | phenyl | —$CH_2CH_3$ | —$CH_2(CH)_2SO_3H$ | $OCH_3$ | H |
| 14 | Cl | phenyl | —$CH_2CH_3$ | —$CH_2CH_2CH(CH_3)SO_3H$ | H | H |
| 15 | Cl | Cl | —$CH_2CH_3$ | —$CH_2CONH(CH_2)_2SO_3H$ | H | H |
| 16 | H | | —$CH_2CH_3$ | —$CH_2(CH)_2SO_3H$ | H | H |

4. The element of claim 3 wherein said first dye is dye 5 of Table 1.

5. The element of claim 4 wherein the second dye is selected from the group consisting of dyes 3, 7, 12, 13, 14 and 15 of Table 1.

6. The element of claim 2 wherein the first dye is dye 2 of Table 1 and the second dye is dye 6 of Table 1.

7. The element of claim 4 wherein the second dye is dye 3 of Table 1.

8. The element of any one of the preceding claims wherein the silver halide emulsion has tabular grains.

* * * * *